US005554338A

United States Patent [19]

Sugihara et al.

[11] Patent Number: 5,554,338

[45] Date of Patent: Sep. 10, 1996

[54] METHOD OF PREPARING COMPOSITE SINTERED BODY

[75] Inventors: Hiroshi Sugihara; Hiroyuki Ishikawa; Tsutomu Uemura, all of Chiba; Akira Fujiki, Kanagawa; Hiromasa Imazato, Chiba; Shinichi Umino, Kanagawa, all of Japan

[73] Assignees: Nissan Motor Co., Ltd., Kanagawa; Hitachi Powdered Metals Co., Ltd., Chiba, both of Japan

[21] Appl. No.: 423,577

[22] Filed: Apr. 18, 1995

[30] Foreign Application Priority Data

Apr. 19, 1994 [JP] Japan ..... 6-080658

[51] Int. Cl.[6] ..... B22F 7/02

[52] U.S. Cl. ..... 419/5; 419/6; 419/30; 419/31; 419/32; 419/35; 419/36; 419/37; 419/38; 419/46; 419/53

[58] Field of Search ..... 419/5, 6, 30, 31, 419/32, 35, 36, 37, 38, 46, 53

[56] References Cited

U.S. PATENT DOCUMENTS

| | | | |
|---|---|---|---|
| 4,054,449 | 10/1977 | Dunn et al. | 75/208 R |
| 4,503,009 | 3/1985 | Asaka | 419/6 |
| 4,721,598 | 1/1988 | Lee | 419/8 |
| 4,946,499 | 8/1990 | Sakuranda et al. | 75/343 |
| 5,279,640 | 1/1994 | Ogufa et al. | 75/343 |
| 5,368,630 | 11/1994 | Luk | 75/252 |

FOREIGN PATENT DOCUMENTS

| | | | |
|---|---|---|---|
| 58-193304 | 2/1984 | Japan | B22F 7/06 |
| 62-35442 | 8/1987 | Japan . | |
| 63-15961 | 4/1988 | Japan . | |
| 1-165701 | 6/1989 | Japan . | |
| 5-148505 | 6/1993 | Japan . | |
| 9507954 | 11/1981 | United Kingdom . | |

OTHER PUBLICATIONS

"Funmatsu Yakin Gairon", pp. 84–87, Shoji et al., published by Kyoritsu Shuppan Co. 1984.

*Primary Examiner*—Donald P. Walsh
*Assistant Examiner*—John N. Greaves
*Attorney, Agent, or Firm*—Lowe, Price, LeBlanc & Becker

[57] ABSTRACT

The invention relates to a method of preparing a composite sintered body having inner and outer portions fitted with each other. The method includes the steps of: (a) preparing an inner powder compact; (b) preparing an outer powder compact; (c) fitting the inner and outer powder compacts with each other so as to prepare a composite powder compact; and (d) sintering the composite powder compact so as to prepare the composite sintered body. The inner and outer powder compacts are respectively selected such that, during the step (d), the amount of growth of the inner powder compact becomes greater than that of the outer powder compact. Each of the inner and outer composite powder compacts is made of one member selected from the group consisting of a wax-type segregation prevention powder mixture and a metal-soap-type segregation prevention powder mixture. At least one of the inner and outer composite powder compacts is made of the wax-type segregation prevention powder. According to the method, the mechanical property of each of the inner and outer portions of the composite sintered body is not limited, and the bonding strength between the inner and outer portions is substantially high.

27 Claims, 1 Drawing Sheet

METHOD OF PREPARING COMPOSITE SINTERED BODY

BACKGROUND OF THE INVENTION

The present invention relates to a method of preparing a composite sintered body having inner and outer portions fitted with each other, which body is used as various machine elements such as sprockets, gears and cams.

Hitherto, there have been proposed methods of preparing a sintered body having inner and outer portions fitted with each other. For example, JP-B-62-35442 discloses a method of preparing a sintered body, in which method the carbon content of an inner powder compact is greater than that of an outer powder compact by at least 0.2 wt % and the inner and outer powder compacts fitted with each other are sintered. With this, the bonding strength between the inner and outer portions of the sintered body is improved. JP-B-63-15961 discloses another method of preparing a sintered body, in which method the carbon content of an inner powder compact is greater than that of an outer powder compact by at least 0.2 wt % and at least 50 wt % of iron powder of at least one of inner and outer powder compacts is a reduced iron powder. With this, a sintered body having an improved bonding strength between the inner and outer portions is produced with a low cost. According to JP-B-62-35442, the carbon content having a great influence on the hardness and mechanical strength of the sintered body is limited to a certain range. According to JP-B-63-15961, the carbon content is limited to a certain range and the iron powder is limited to a certain type. Thus, according to these publications, the mechanical property of each of the inner and outer portions of the sintered body is restricted. Thus, such mechanical property does not always meet the demand.

SUMMARY OF THE INVENTION

It is therefore an object of the present invention to provide an improved method of preparing a composite sintered body having inner and outer portions fitted with each other, in which body the mechanical property of each of the inner and outer portions is not limited, and the bonding strength between the inner and outer portions is substantially high.

According to the present invention, there is provided a method of preparing a composite sintered body having inner and outer portions fitted with each other, the method comprising the steps of:

(a) preparing an inner powder compact;

(b) preparing an outer powder compact;

(c) fitting the inner and outer powder compacts with each other so as to prepare a composite powder compact; and (d) sintering the composite powder compact so as to prepare the composite sintered body, wherein the inner and outer powder compacts are respectively selected such that, during the step (d), the amount of growth of the inner powder compact becomes greater than that of the outer powder compact, wherein each of the inner and outer composite powder compacts is made of one member selected from the group consisting of a wax-type segregation prevention powder mixture and a metal-soap-type segregation prevention powder mixture, and wherein at least one of the inner and outer composite powder compacts is made of the wax-type segregation prevention powder.

Accordingly, inner and outer composite powder compacts for respectively preparing the inner and outer portions of the sintered body are in good contact with each other upon sintering and the diffusion of elements at the boundary surface between the inner and outer portions tends to increase upon sintering. Therefore, the bonding strength between the inner and outer portions becomes substantially high after sintering.

DESCRIPTION OF THE PREFERRED EMBODIMENTS

Figure 1:
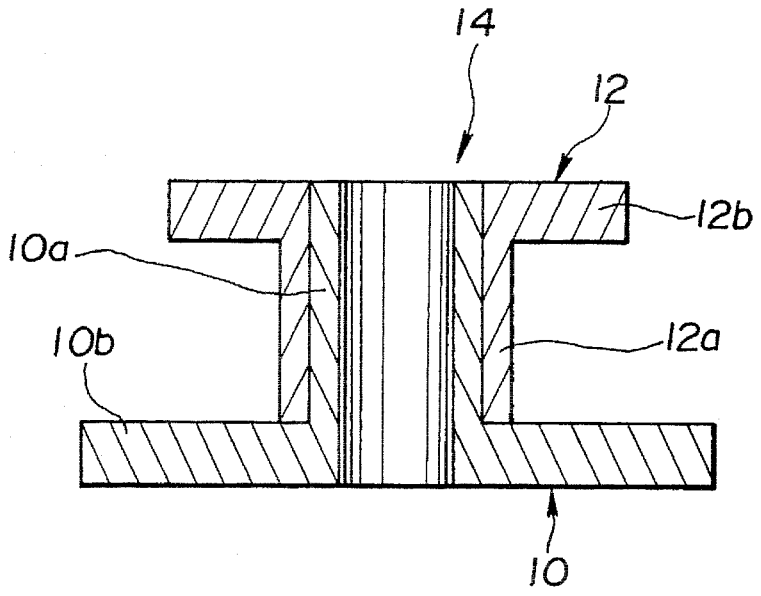
FIG. 1 is a sectional view showing inner and outer composite powder compacts according to Examples 1–3 and Comparative Examples 1–3.

In the following, an improved method of preparing a composite sintered body having inner and outer portions fitted with each other will be described in accordance with the present invention.

In a method according to the present invention, inner and outer composite powder compacts are brought into fit with each other, and then these compacts are sintered. With this, inner and outer portions of the composite sintered body are bonded with each other, and the composite sintered body becomes one-piece or monolithic in construction.

In the invention, inner and Outer composite powder compacts which are special in relation to each other are used. In fact, the inner and outer composite powder compacts have a first feature that, during the inner and outer powder compacts are sintered, the amount of growth (expansion) of the inner powder compact becomes greater than that of the outer powder compact. Furthermore, the inner and outer composite powder compacts have a second feature that each of the inner and outer composite powder compacts is made of one member selected from the group consisting of a so-called wax-type segregation prevention powder mixture and a so-called metal-soap-type segregation prevention powder mixture and that at least one of the inner and outer composite powder compacts is made of the wax-type segregation prevention powder. The inventors have unexpectedly found that the above-mentioned second feature enhances the above-mentioned first feature. In other words, as compared with the inner and outer composite powder compacts having only the above-mentioned first feature, those powder compacts according to the present invention having the above-mentioned first and second features are such that the amount of growth of the inner powder compact becomes much greater than that of the outer powder compact. With this, the contact area between the inner and outer powder compacts becomes substantially large. Thus, diffusion of elements tends to increase at the boundary surface between the inner and outer powder compacts. Therefore, the bonding strength between the inner and outer portions of the sintered composite body becomes substantially high.

As the above-mentioned wax-type segregation prevention powder mixture and a method of preparing the same, a special iron-matrix powder mixture and a method of preparing the same which are disclosed in JP-A-5-148505 can be used. In the wax-type segregation prevention powder mixture, an alloying (additive) powder such as copper powder and/or graphite powder is bonded to the surface of a matrix powder such as iron powder through a special binder. With this, segregation of the alloying powder can be prevented.

The wax-type segregation prevention powder mixture comprises a matrix powder, an alloying powder and a binder. In a method of preparing the wax-type powder mixture, at first, these components are mixed together. Then, this mixture is heated at a certain temperature such that the binder is fused or melted and thus the alloying powder is bonded to the matrix powder through the fused binder. It is preferable that the mixture is stirred during this heating. Then, the heated mixture is cooled down for preparing the wax-type powder mixture in which the alloying powder is bonded to the surface of matrix powder through the fused binder. In fact, when the binder is made of only one substance having a melting point of X° C., the above certain temperature is within a range from (X+10) °C. to (X+100) °C. For example, when the binder is made of only stearic acid (melting point: 69° C.), the above certain temperature is within a range from 79° to 169° C. When the binder is made of at least two substances which have the lowest melting point of Y° C. and the highest melting point of Z° C., the above certain temperature is within a range from (Y+10) °C. to Z° C. For example, as is shown in Example 3, when the binder is made of stearic acid and ethylene bisstearic acid amide (melting point: 147° C.), the above certain temperature is within a range from 79° to 147° C.

The wax-type powder mixture further optionally comprises at least one separate powder as a lubricant. Hereinafter, the term of "separate powder" means that this powder is mixed with other components, but not bonded with other components. A method of preparing the wax-type powder mixture of this type is substantially similar to the above-mentioned method, except in that the at least one separate powder is finally added to and mixed with, at room temperature which is within a range from about 2 to about 35° C., the cooled mixture (the matrix powder, the alloying powder and the binder). Therefore, as is mentioned hereinabove, the at least one separate powder is mixed with other components, but not bonded therewith. The at least one separate powder serves to improve releasibility of a composite sintered body from a mold.

A first example of the wax-type segregation prevention powder mixture comprises a mixture of an iron matrix powder, an alloying powder and a special binder. The binder is a fused mixture of first and second organic substances. The first substance is at least one selected from the group consisting of stearic acid, oleic acid monoamide and stearic acid monoamide. The second substance is at least one selected from the group consisting of ethylene bisstearic acid amide and methylene bisstearic acid amide.

A second example of the wax-type powder mixture comprises a mixture of an iron matrix powder, an alloying powder, 0.1–1.0 wt % of a binder, 0.1–0.5 wt % of a first separate powder, and 0.01–0.2 wt % of a second separate powder made of zinc stearate. The binder is a fused material of at least one member selected from a first group consisting of stearic acid (melting point: 69° C.), oleic acid amide (melting point: 76° C.), stearic acid amide (melting point: 103° C.), a fused mixture (melting point: 125° C.) of stearic acid amide and ethylene bisstearic acid amide, and ethylene bisstearic acid amide (melting point: 147° C.). The first separate powder is at least one selected from the above first group.

A third example of the wax-type segregation prevention powder mixture is substantially the same as the second example except in that this wax-type powder mixture further comprises 0.01–0.3 wt % of an organic liquid type lubricant which is mixed with other components prior to the heating for fusing the binder. This lubricant is at least one selected from the group consisting of oleic acid, spindle oil and turbine oil.

A fourth example of the wax-type segregation prevention powder mixture comprises a mixture of an iron matrix powder, an alloying powder, 0.1–1.0 wt % of a binder and 0.1–1.0 wt % of a separate powder made of a lithium salt of a higher fatty acid. This binder is a fused material of at least one selected from the group consisting of higher fatty acids, higher fatty acid amides and waxes. Preferable examples of the higher fatty acids and the higher fatty acid amides are compounds and compound mixtures selected from the above-mentioned first group, which have melting points close to the melting point of zinc stearate which is a conventional lubricant in the field of powder metallurgy. Similar to the higher fatty acids and the higher fatty acid amides, preferable examples of the waxes are compounds which have melting points close to the melting point of zinc stearate, such as low molecular weight polyethylene waxes having melting points within a range from 100° to 150° C. and molecular weights within a range from 1,000 to 5,000. Preferable examples of the lithium salts of higher fatty acids are lithium stearate and lithium behenate.

A fifth example of the wax-type segregation prevention powder mixture is substantially the same as the fourth example in composition except in that a first separate powder which is within a range greater than 0 wt % and up to 0.5 wt % is further added to and mixed with the fourth example at room temperature (from about 2° to about 35° C.) after cooling the mixture. This first separate powder is a powder of at least one selected from the group consisting of higher fatty acids, higher fatty acid amides and waxes. Preferable examples of these higher fatty acids, higher fatty acid amides and waxes are the same as those of the fourth example.

A sixth example of the wax-type segregation prevention powder is a mixture of an iron matrix powder, an alloying powder and a binder. This binder is a fused mixture of 0.3–2.0 wt % of at least one selected from the group consisting of higher fatty acids and waxes and 0.01–0.1 wt % of zinc stearate powder. Preferable examples of these higher fatty acids and waxes are the same as those of the fourth example.

A seventh example of the wax-type segregation prevention powder is substantially the same as the sixth example except in that a separate powder which is within a range greater than 0 wt % and up to 1.0 wt % is further mixed with the sixth example at room temperature (from about 2° to about 35° C.). This separate powder is a powder of at least one selected from the group consisting of lithium salts of higher fatty acids, higher fatty acid amides and waxes. Preferable examples of these higher fatty acid amides and waxes are the same as those of the fourth example.

As the above-mentioned metal-soap-type segregation prevention powder and a method of preparing the same, special iron-matrix powder mixtures and a method of preparing the same which are disclosed in JP-A-1-165701 may be used. In the metal-soap-type segregation prevention powder, an alloying (additive) powder such as copper powder and/or graphite powder is bonded to the surface of a matrix powder such as iron powder through a special binder. With this, segregation of the alloying metal powder can be prevented. In fact, the binder is a fused powder mixture of an oil and a metal soap or wax. It is preferable that the weight ratio of the oil to the metal soap or wax is within a range from 0.1 to 0.4. Preferable examples of the oil and the metal soap are oleic acid and zinc stearate, respectively.

In a method of preparing the metal-soap-type segregation prevention powder mixture, at first, an iron powder, an alloying powder and a powder of metal soap or wax are mixed together. Then, an oil is added to this mixture. Then, while the mixture is stirred or after the mixture is stirred, the mixture is heated at a temperature within a range from 90° to 150° C. such that the binder is fused or melted and thus the alloying powder is bonded to the matrix powder through the fused binder. Then, while the mixture is stirred, the heated mixture is cooled down to a temperature not higher than 85° C. such that the metal-soap-type powder mixture is prepared.

The above-mentioned wax-type and metal-soap-type segregation prevention powders are more stable in powder mixture property and powder compact property, as compared with conventional segregation prevention powders in which a thermoplastic resin, tall oil or the like is used as a binder. As compared with a simple powder mixture in which components thereof are mixed together but not bonded with each other, segregation prevention powders according to the present invention in which an alloying powder is bonded to a matrix powder through a binder can further enhances the above-mentioned first feature of the inner and outer powder compacts. It may be considered that this action is caused by the difference of thermal expansion between a wax or a fused mixture of an oil and a metal soap and zinc stearate, the occurrence of a catalytic action, and the like.

For the purpose of imparting the above-mentioned first feature to the inner and outer composite powder compacts, it is preferable that each of the inner and outer composite powder compacts contains copper as an alloying powder and that the copper content of the inner composite powder compact is greater than that of the outer composite powder compact by at least 0.3 wt %. With this, when the inner and outer powder compacts are sintered, the amount of growth (expansion) of the inner powder compact becomes greater than that of the outer powder compact. The addition of copper to an iron matrix powder contributes to improve hardenability and thus to improve the material strength. Furthermore, it contributes to adjust the dimensions of a sintered body. In general, if copper is added to a powder compact, this powder compact grows upon sintering at about the melting temperature of copper. This growth phenomena by the addition of copper is called "copper growth" (see "Funmatsu Yakin Gairon" which is written in Japanese and by Shoji, Nagai and Akiyama and published by Kyoritsu Shuppan Co. in 1984). In the invention, it is preferable that the copper content of the inner powder compact is greater than that of the outer powder compact by at least 0.3 wt %. With this, the growth of the inner powder compact becomes greater than that of the outer powder compact upon sintering. Therefore, the degree of contact between the inner and outer powder compacts becomes high. With this, diffusion of elements at the boundary between the inner and outer powder compacts increases. Therefore, the bonding strength between the inner and outer portions of a sintered body becomes high. This bonding strength is further enhanced by imparting the above-mentioned second feature to the inner and outer composite powder compacts. If the copper content of the inner powder compact is not greater than that of the outer powder compact by at least 3 wt %, the phenomena of "copper growth" does not become sufficient. With this, the bonding strength between the inner and outer portions of a sintered body becomes insufficient.

A method of preparing a composite sintered body, using the above-mentioned special powder mixtures of the present invention will be briefly described in the following. The special powder mixtures are compacted by a conventional method so as to prepare the inner and outer composite powder compacts, respectively. Then, the inner and outer composite powder compacts are fitted with each other so as to prepare a composite powder compact. Then, this composite powder compact is sintered by a conventional method so as to prepare the composite sintered body.

The present invention will be illustrated with the following nonlimitative examples. In the following Examples and Comparative Examples, the weight percent of each component of the powder mixtures is based on the total weight of the powder mixture, unless otherwise stated.

EXAMPLE 1

In this example, as is seen from FIG. 1, inner and outer powder compacts 10, 12 were brought into fit with each other so as to prepare a composite powder compact 14. The inner powder compact had a cylindrical portion 10*a* and a lower end flange portion 10*b* having an outer diameter of 112 mm. The cylindrical portion 10*a* had an outer diameter of 32 mm, a thickness of 6 mm, and a length of 24 mm. The outer powder compact 12 having a total length of 24 mm had a cylindrical portion 12*a* and an upper end flange portion 12*b* having an outer diameter of 79 mm. The cylindrical portion 12*a* had an outer diameter of 44 mm and a thickness of 6 mm.

In this example, a wax-type segregation prevention powder mixture was used for preparing both of the inner and outer powder compacts. In a method of preparing the wax-type powder mixture, at first, 0.4 wt % of methylene bisstearic acid amide, 0.4 wt % of oleic acid monoamide, Cu and graphite powders in amounts specified in Table 1 were added to an iron matrix powder. Then, this mixture was heated at 120° C. for 20 min so as to fuse the binder, while this mixture was stirred. Then, this mixture was cooled down for use. The content of each component of the inner and outer powder compacts is shown in Table 1.

As is seen from FIG. 1, the thus prepared wax-type powder mixtures were compacted to prepare the inner and outer powder compacts. Then, the inner and outer powder compacts were fitted with each other so as to prepare a composite powder compact. Then, this composite powder compact was sintered at a temperature of 1140° C. for 20 minutes so as to prepare a composite sintered body. On this sintered body, a separation force for separating the inner and outer sintered portions from each other was added to the composite sintered body, and this force was measured. The result is shown in Table 1.

EXAMPLE 2

In this example, Example 1 was substantially repeated except in that other powders were respectively used for preparing the inner and outer powder compacts. In fact, wax-type and metal-soap-type segregation prevention powders were respectively used for preparing the inner and outer powder compacts. In a method of preparing the wax-type segregation prevention powder mixture, at first, 0.4 wt % of a fused mixture of stearic acid amide and ethylene bisstearic acid amide (the weight ratio of the former to the latter was 1:1), Cu and graphite powders in amounts specified in Table 1 were added to an iron matrix powder. Then, this mixture was heated at a temperature of 110° C. for 10 min so as to fuse the binder while the mixture was stirred. Then, this mixture was cooled down. Then, 0.3 wt % of the above fused mixture of stearic acid amide and ethylene bisstearic acid amide and 0.1 wt % of zinc stearate were added to the mixture, and then the mixture was stirred for 10 min at room temperature.

In a method of preparing the metal-soap-type segregation prevention powder mixture, at first, 0.6 wt % of zinc stearate, Cu and graphite powders in amounts specified in Table 1 were added to an iron matrix powder, and then this mixture was stirred. Then, 0.2 wt % of spindle oil was uniformly mixed with the mixture. Then, the mixture was heated at a temperature of 110° C. by steam so as to fuse the binder while the mixture was stirred. Then, the mixture was cooled down to a temperature not higher than 85° C. while the mixture was stirred. The content of each component of the inner and outer powder compacts is shown in Table 1.

EXAMPLE 3

In this example, Example 1 was substantially repeated except in that other powders were respectively used for preparing the inner and outer powder compacts. In fact, metal-soap-type and wax-type segregation prevention powder mixtures were respectively used for preparing the inner and outer powder compacts. In a method of preparing the wax-type segregation prevention powder mixture, at first, 0.4 wt % of stearic acid, 0.4 wt % of ethylene bisstearic acid amide, Cu and graphite powders in amounts specified in Table 1 were added to an iron matrix powder. Then, this mixture was heated at a temperature of 120° C. for 20 min so as to fuse the binder while the mixture was stirred. Then, the heated mixture was cooled down for use.

In a method of preparing the metal-soap-type segregation prevention powder mixture, the method of Example 2 was repeated except in that Cu and graphite powders in amounts specified in Table 1 were used. The content of each component of the inner and outer powder compacts is shown in Table 1.

The separation forces of Examples 1–3 were sufficiently high. Therefore, the composite sintered bodies of Examples 1–3 were suitable for preparing various mechanical elements of high strength.

COMPARATIVE EXAMPLE 1

In this example, Example 1 was substantially repeated except in that other powders were respectively used for preparing the inner and outer powder compacts. In fact, a wax-type segregation prevention powder according to the present invention and a simple powder mixture not according to the present invention were respectively used for preparing the inner and outer powder compacts. In a method of preparing the wax-type segregation prevention powder mixture, at first, 0.4 wt % of stearic acid, 0.4 wt % of stearic acid amide, Cu and graphite powders in amounts specified in Table 1 were added to an iron matrix powder. Then, the mixture was heated at a temperature of 120° C. for 20 min so as to fuse the binder while the mixture was stirred. Then, the heated mixture was cooled down for use.

The simple powder mixture was prepared by mixing, at room temperature, an iron matrix powder, 0.80 wt % of zinc stearate, and Cu and graphite powders in amounts specified in Table 1. The content of each component of the inner and outer powder compacts is shown in Table 1.

COMPARATIVE EXAMPLE 2

In this example, Example 1 was substantially repeated except in that another powder was used for preparing the inner and outer powder compacts. In fact, a metal-soap-type segregation prevention powder was used for preparing both of the inner and outer powder compacts. This was not in accordance with the present invention. In a method of preparing the metal-soap-type segregation prevention powder mixture, the method of Example 2 was substantially repeated except in that Cu and graphite powders in amounts specified in Table 1 were used. The content of each component of the inner and outer powder compacts is shown in Table 1.

COMPARATIVE EXAMPLE 3

In this example, Example 1 was substantially repeated except in that other powders were respectively used for preparing the inner and outer powder compacts. In fact, a simple powder mixture not according to the present invention and a wax-type segregation prevention powder of the present invention were respectively used for preparing the inner and outer powder compacts. In methods of respectively preparing the wax-type and metal-soap-type segregation prevention powder mixtures, the methods of Comparative Example 1 were respectively substantially repeated except in that Cu and graphite powders in amounts specified in Table 1 were used. The content of each component of the inner and outer powder compacts is shown in Table 1.

EXAMPLE 4

Figure 2:
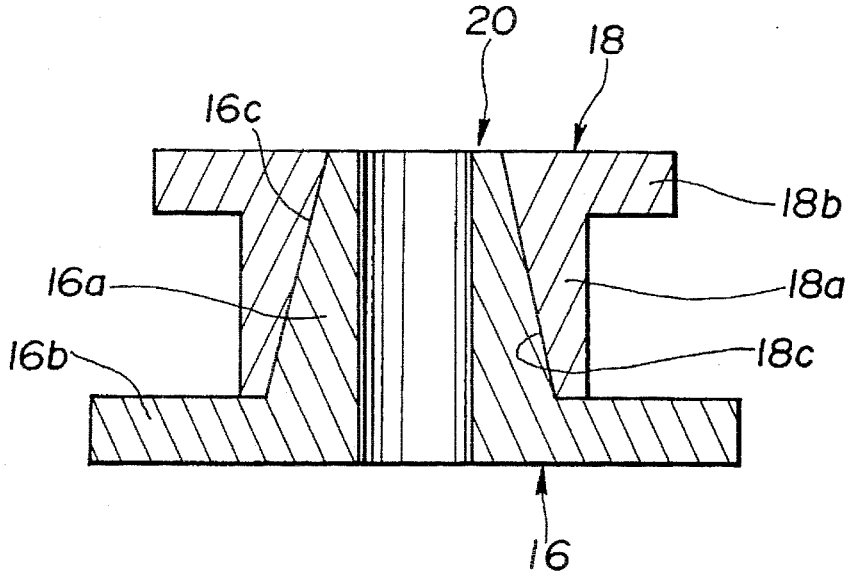
FIG. 2 is a view similar to FIG. 1, but in accordance with Examples 4–6 and Comparative Examples 4–5.

In this example, Example 1 was slightly modified as follows. As is seen from FIG. 2, inner and outer powder compacts 16, 18 were brought into fit with each other so as to prepare a composite powder compact 20. The inner powder compact 16 had a tapered cylindrical portion **16*a* and a lower end flange portion 16*b* having an outer diameter of 112 mm. The cylindrical portion 16*a* had an inner diameter of 20 mm and a length of 24 mm. The cylindrical portion 16*a* had a tapered surface 16*c* having a taper ratio of 15:100. The outer powder compact 18 having a total length of 24 mm had a cylindrical portion 18*a* having a tapered surface 18*c* which is to be in fit with the tapered surface 16*c*, and an upper end flange portion 18*b* having an outer diameter of 79 mm. The cylindrical portion 18*a* had an outer diameter of 44 mm. The tapered surface 18*c*** had a taper ratio of 15:100.

In this example, a wax-type segregation prevention powder mixture was used for preparing both of the inner and outer powder compacts. In a method of preparing the wax-type powder mixture for the inner powder compact, at first, 0.4 wt % of a fused mixture of stearic acid amide and ethylene bisstearic acid amide, and Cu and graphite powders in amounts specified in Table 2 were mixed with an iron matrix powder at a temperature of 110° C. for 10 min while the mixture was stirred. Then, the mixture was cooled down. Then, 0.3 wt % of lithium behenate was mixed with the mixture at a temperature of 25° C. so as to prepare the wax-type powder mixture. In a method of preparing the wax-type powder mixture for the outer powder compact, the above method for the inner powder compact was repeated except in that Cu and graphite powders in amounts specified in Table 2 and 0.4 wt % of lithium behenate were used. The content of each component of the inner and outer powder compacts is shown in Table 2.

EXAMPLE 5

In this example, Example 4 was substantially repeated except in that other powders were respectively used for preparing the inner and outer powder compacts. In fact, wax-type and metal-soap-type segregation prevention powder mixtures were respectively used for preparing the inner and outer powder compacts.

In a method of preparing the wax-type powder mixture, at first, 0.2 wt % of polyethylene wax, 0.2 wt % of stearic acid amide, 0.1 wt % of zinc stearate, and Cu and graphite powders in amounts specified in Table 2 were added to an iron matrix powder. Then, this mixture was heated at a temperature of 110° C. for 10 min so as to fuse the binder while the mixture was stirred. Then, the heated mixture wad cooled down. Then, 0.3 wt % of lithium behenate was mixed with the mixture at a temperature of 25° C. so as to prepare the wax-type powder mixture.

In a method of preparing the metal-soap-type powder mixture, the method of Example 2 was repeated except in that Cu and graphite powders in amounts specified in Table 2 were used. The content of each component of the inner and outer powder compacts is shown in Table 2.

EXAMPLE 6

In this example, Example 4 was substantially repeated except in that other powders were respectively used for preparing the inner and outer powder compacts. In fact, wax-type and metal-soap-type segregation prevention powders were respectively used for preparing the inner and outer powder compacts.

In a method of preparing the wax-type powder mixture, at first, 0.5 wt % of stearic acid, 0.2 wt % of ethylene bisstearic acid amide, and Cu and graphite powders in amounts specified in Table 2 were added to an iron matrix powder. Then, the mixture was heated at a temperature of 110° C. for 10 min while the mixture was stirred. Then, the heated mixture was cooled down for use thereof.

In a method of preparing the metal-soap-type powder mixture, the method of Example 2 was repeated except in that 0.5 wt % of zinc stearate, and Cu and graphite powders in amounts specified in Table 2 were used.

The content of each component of the inner and outer powder compacts is shown in Table 2.

The separation forces of Examples 4–6 were sufficiently high. Therefore, the composite sintered bodies of Examples 4–6 were suitable for preparing various mechanical elements of high strength.

COMPARATIVE EXAMPLE 4

In this example, Example 4 was substantially repeated except in that another powder was used for preparing both of the inner and outer powder compacts. As is shown in Table 2, the copper content of the inner powder compact was greater than that of the outer powder compact by only 0.2 wt %. This is not in accordance with the present invention. In fact, a wax-type segregation prevention powder was used for preparing the inner and outer powder compacts.

In a method of preparing the wax-type powder mixture, the method of Example 4 was repeated except in that 0.4 wt % of lithium behenate, and Cu and graphite powders in amounts specified in Table 2 were used.

The content of each component of the inner and outer powder compacts is shown in Table 2.

COMPARATIVE EXAMPLE 5

In this example, Example 4 was substantially repeated except in that another powder was used for preparing both of the inner and outer powder compacts. As is shown in Table 2, the copper content of the inner powder compact was lower than that of the outer powder compact by 1.5 wt %. This is not according to the present invention. In fact, wax-type segregation prevention powders were used for preparing the inner and outer powder compacts.

In a method of preparing the wax-type powder mixture for the inner powder compact, the method of Example 4 was repeated except in that 0.45 wt % of lithium behenate, and Cu and graphite powders in amounts specified in Table 2 were used. In a method of preparing the wax-type powder mixture for the outer powder compact, the method of Example 4 for the inner powder compact was repeated except in that Cu and graphite powders in amounts specified in Table 2 were used.

The content of each component of the inner and outer powder compacts is shown in Table 2.

TABLE 1

| | Inner Powder Compact (wt %) | | | | Outer Powder Compact (wt %) | | | | |
|---|---|---|---|---|---|---|---|---|---|
| | Fe | Cu | Graphite | Lubricant and/or Binder | Fe | Cu | Graphite | Lubricant and/or Binder | Separation Force (ton) |
| Ex. 1 | Balance | 3.0 | 1.0 | 0.80 | Balance | 1.5 | 0.9 | 0.80 | 16 |
| Ex. 2 | Balance | 3.0 | 1.0 | 0.80 | Balance | 1.5 | 0.9 | 0.80 | 15 |
| Ex. 3 | Balance | 3.0 | 1.0 | 0.80 | Balance | 1.5 | 0.9 | 0.80 | 15 |
| Com. Ex. 1 | Balance | 3.0 | 1.0 | 0.80 | Balance | 1.5 | 0.9 | 0.80 | 10.5 |
| Com. Ex. 2 | Balance | 3.0 | 1.0 | 0.80 | Balance | 1.5 | 0.9 | 0.80 | 11 |
| Com. Ex. 3 | Balance | 3.0 | 1.0 | 0.80 | Balance | 1.5 | 0.9 | 0.80 | 10 |

TABLE 2

| | Inner Powder Compact (wt %) | | | | Outer Powder Compact (wt %) | | | | |
|---|---|---|---|---|---|---|---|---|---|
| | Fe | Cu | Graphite | Lubricant and/or Binder | Fe | Cu | Graphite | Lubricant and/or Binder | Separation Force (ton) |
| Ex. 4 | Balance | 2.5 | 0.8 | 0.70 | Balance | 1.2 | 1.0 | 0.80 | 18 |
| Ex. 5 | Balance | 2.7 | 0.7 | 0.80 | Balance | 1.0 | 0.8 | 0.80 | 16 |

TABLE 2-continued

| | Inner Powder Compact (wt %) | | | | Outer Powder Compact (wt %) | | | | |
|---|---|---|---|---|---|---|---|---|---|
| | Fe | Cu | Graphite | Lubricant and/or Binder | Fe | Cu | Graphite | Lubricant and/or Binder | Separation Force (ton) |
| Ex. 6 | Balance | 3.0 | 0.6 | 0.75 | Balance | 1.0 | 0.7 | 0.60 | 15 |
| Com. Ex. 4 | Balance | 2.7 | 0.8 | 0.80 | Balance | 2.5 | 1.0 | 0.80 | 9.5 |
| Com. Ex. 5 | Balance | 1.5 | 0.6 | 0.85 | Balance | 3.0 | 1.0 | 0.70 | 6 |

What is claimed is:

1. A method of preparing a composite sintered body having inner and outer portions fitted with each other, the method comprising the steps of:

(a) preparing an inner powder compact;

(b) preparing an outer powder compact;

(c) fitting the inner and outer powder compacts with each other so as to prepare a composite powder compact; and (d) sintering the composite powder compact so as to prepare the composite sintered body, wherein the inner and outer powder compacts are respectively selected such that, during the step (d), the amount of growth of the inner powder compact becomes greater than that of the outer powder compact, wherein each of the inner and outer composite powder compacts is made of one member selected from the group consisting of a wax-type segregation prevention powder mixture and a metal-soap-type segregation prevention powder mixture, and wherein at least one of the inner and outer composite powder compacts is made of the wax-type segregation prevention powder.

2. A method according to claim 1, wherein each of the inner and outer powder compacts contains an iron powder as a matrix powder and an alloying powder including a copper powder, and wherein the copper content of the inner powder compact is higher than that of the outer powder compact by at least 0.3 wt %, so that, during the step (d), the amount of growth of the inner powder compact becomes greater than that of the outer powder compact.

3. A method according to claim 2, wherein the alloying powder further includes a graphite powder.

4. A method according to claim 1, wherein the inner powder compact has a first cylindrical portion and a first flange portion formed on an end of the first cylindrical portion, wherein the outer powder compact has a second cylindrical portion and a second flange portion formed on an end of the second cylindrical portion, and wherein the second cylindrical portion of the outer powder compact is fitted into the first cylindrical portion of the inner powder compact such that the composite powder compact has the first and second flange portions at both ends of the composite powder compact.

5. A method according to claim 4, wherein the first cylindrical portion of the inner powder compact is tapered in shape and the second cylindrical portion of the outer powder compact has a surface which is to be fit with the first cylindrical portion.

6. A method according to claim 1, wherein the wax-type segregation prevention powder mixture comprises a mixture of an iron matrix powder, an alloying powder and a binder, wherein the alloying powder is bonded to a surface of the iron matrix powder through the binder, wherein the binder is a fused mixture of first and second organic substances, wherein the first substance is at least one selected from the group consisting of stearic acid, oleic acid monoamide and stearic acid monoamide, and wherein the second substance is at least one selected from the group consisting of ethylene bisstearic acid amide and methylene bisstearic acid amide.

7. A method according to claim 6, wherein at least one of the steps (a) and (b) comprises the sub-steps of:

(1) mixing the iron matrix powder, the alloying powder and the binder together so as to prepare a first mixture;

(2) heating the first mixture at a certain temperature so as to fuse the binder and thus to bond the alloying powder to the iron matrix powder through the fused binder;

(3) cooling down the heated first mixture so as to prepare the wax-type segregation prevention powder mixture; and (4) compacting the wax-type powder mixture so as to prepare at least one of the inner and outer powder compacts.

8. A method according to claim 7, wherein, when the first and second organic substances have the lowest melting point of X° C. and the highest melting point of Y° C., the certain temperature is within a range from (X+10) °C. to Y° C.

9. A method according to claim 1, wherein the wax-type powder mixture comprises a mixture of an iron matrix powder, an alloying powder, 0.1–1.0 wt % of a binder, 0.1–0.5 wt % of a first separate powder, and 0.01–0.2 wt % of a second separate powder made of zinc stearate, wherein the binder is a fused material of at least one member selected from the group consisting of stearic acid, oleic acid amide, stearic acid amide, a fused mixture of stearic acid amide and ethylene bisstearic acid amide, and ethylene bisstearic acid amide, and wherein the first separate powder is at least one selected from the group consisting of stearic acid, oleic acid amide, stearic acid amide, a fused mixture of stearic acid amide and ethylene bisstearic acid amide, and ethylene bisstearic acid amide.

10. A method according to claim 9, wherein at least one of the steps (a) and (b) comprises the sub-steps of:

(1) mixing the iron matrix powder, the alloying powder and the binder together so as to prepare a first mixture;

(2) heating the first mixture at a certain temperature so as to fuse the binder and thus to bond the alloying powder to the iron matrix powder through the fused binder;

(3) cooling down the heated first mixture;

(4) mixing the first and second separate powders with the cooled first mixture at room temperature so that the first and second separate powders are mixed with the first mixture but not bonded therewith and that the wax-type powder mixture is prepared; and (5) compacting the wax-type powder mixture so as to prepare at least one of the inner and outer powder compacts.

11. A method according to claim 10, wherein, when the binder is made of only one substance having a melting point of X° C., the certain temperature is within a range from (X+10) °C. to (X+100) °C., and wherein, when the binder is made of at least two substances which have the lowest melting point of Y° C. and the highest melting point of Z° C., the certain temperature is within a range from (Y+10) °C. to Z° C.

12. A method according to claim 10, wherein the wax-type segregation prevention powder mixture further comprises 0.01–0.3 wt % of an organic liquid type lubricant which is at least one selected from the group consisting of oleic acid, spindle oil and turbine oil, and wherein the lubricant is mixed with the first mixture prior to the heating of the same.

13. A method according to claim 10, wherein the room temperature is within a range from about 2° to about 351 ° C.

14. A method according to claim 1, wherein the wax-type segregation prevention powder mixture is a mixture of an iron matrix powder, an alloying powder, 0.1–1.0 wt % of a binder and 0.1–1.0 wt % of a first separate powder of a lithium salt of a higher fatty acid, wherein the alloying powder is bonded to the iron matrix powder through the binder, and wherein the binder is a fused material of at least one selected from the group consisting of higher fatty acids, higher fatty acid amides and waxes.

15. A method according to claim 14, wherein the higher fatty acids and the higher fatty acid amides are compounds or compound mixtures which have melting points close to that of zinc stearate.

16. A method according to claim 15, wherein the higher fatty acids and the higher fatty acid amides are selected from the group consisting of stearic acid, oleic acid amide, stearic acid amide, a fused mixture of stearic acid amide and ethylene bisstearic acid amide and ethylene bisstearic acid amide.

17. A method according to claim 14, wherein the waxes are compounds which have melting points close to that of zinc stearate.

18. A method according to claim 17, wherein the waxes are low molecular weight polyethylene waxes having melting points within a range from 100° to 150° C. and molecular weights within a range from 1,000 to 5,000.

19. A method according to claim 14, wherein the lithium salt is one selected from the group consisting of lithium stearate and lithium behenate.

20. A method according to claim 14, wherein the wax-type segregation prevention powder mixture further comprises a second separate powder which is within a range greater than 0 wt % and up to 0.5 wt %, and the first separate powder is a powder of at least one selected from the group consisting of higher fatty acids, higher fatty acid amides and waxes.

21. A method according to claim 1, wherein the wax-type segregation prevention powder mixture is a mixture of an iron matrix powder, an alloying powder and a binder, wherein the alloying powder is bonded to the iron matrix powder through the binder, wherein the binder is a fused mixture of 0.3–2.0 wt % of at least one selected from the group consisting of higher fatty acids and waxes and 0.01–0.1 wt % of zinc stearate powder.

22. A method according to claim 21, wherein the wax-type segregation prevention powder mixture further comprises a separate powder which is within a range greater than 0 wt % and up to 1.0 wt %, wherein the separate powder is a powder of at least one selected from the group consisting of lithium salts of higher fatty acids, higher fatty acid amides and waxes.

23. A method according to claim 1, wherein the metal-soap-type segregation prevention powder mixture comprises an iron matrix powder, an alloying powder and a binder, wherein the alloying powder is bonded to the iron matrix powder through the binder, and wherein the binder is a fused powder mixture of an oil and one member selected from the group consisting of metal soaps and waxes.

24. A method according to claim 23, wherein one of the steps (a) and (b) comprises the sub-steps of:

(1) mixing the iron matrix powder, the alloying powder and the one member together so as to prepare a first mixture;

(2) mixing the oil with the first mixture so as to prepare a second mixture;

(3) heating the second mixture at a temperature within a range from 90° to 150° C. such that the binder is fused and thus the alloying powder is bonded to the matrix powder through the fused binder;

(4) cooling down the heated second mixture to a temperature not higher than 85° C., while the second mixture is stirred, such that the metal-soap-type powder mixture is prepared; and (5) compacting the metal-soap-type powder mixture so as to prepare one of the inner and outer powder compacts.

25. A method according to claim 23, wherein the oil is oleic acid.

26. A method according to claim 23, wherein the one member is zinc stearate.

27. A method according to claim 23, wherein the weight ratio of the oil to the one member is within a range from 0.1 to 0.4.

* * * * *